United States Patent [19]

Schönbach et al.

[11] 4,171,764

[45] Oct. 23, 1979

[54] CAN LINING BAG OF FLEXIBLE PLASTIC FILM

[75] Inventors: Gerhard Schönbach, Taunusstein; Klaus Heyse, Bad Soden, both of Fed. Rep. of Germany

[73] Assignee: Hoechst Aktiengesellschaft, Frankfurt am Main, Fed. Rep. of Germany

[21] Appl. No.: 784,616

[22] Filed: Apr. 4, 1977

[30] Foreign Application Priority Data

Apr. 7, 1976 [DE] Fed. Rep. of Germany ... 7610787[U]

[51] Int. Cl.[2] ..... B65D 31/00

[52] U.S. Cl. ..... 229/53; 229/48 T; 426/129; 426/411; 428/35; 428/57; 428/192; 220/403; 220/461

[58] Field of Search ..... 428/35, 57, 192; 220/63 R, 403, 404, 461, 462; 229/53, 55, 48 T, 48 S, 48 A, 48 SB; 426/124, 129, 398, 410, 411

[56] References Cited

U.S. PATENT DOCUMENTS

| | | | |
|---|---|---|---|
| 2,833,460 | 5/1958 | Votolato | 229/53 |
| 2,930,707 | 3/1960 | Linnell et al. | 426/129 |
| 3,204,760 | 9/1965 | Whiteford | 229/53 |
| 3,355,303 | 11/1967 | Meyers | 229/53 |
| 3,382,132 | 5/1968 | Kugler | 229/53 |

*Primary Examiner*—William R. Dixon, Jr.

*Attorney, Agent, or Firm*—Schwartz, Jeffery, Schwaab, Mack, Blumenthal & Koch

[57] ABSTRACT

Disclosed is a bag adapted for lining the inside of a container, comprising side walls and a closed end wall comprised of a flexible synthetic resinous sheet material and an open end wall opposite to the closed end wall, wherein the inside circumference of the bag defined by the side walls becomes increasingly larger from an intermediate point on the side walls in the direction of the open end wall, while the outside circumference preferably remains substantially constant.

11 Claims, 2 Drawing Figures

CAN LINING BAG OF FLEXIBLE PLASTIC FILM

BACKGROUND OF THE INVENTION

The present invention relates to a bag of flexible plastic film and more especially to such a bag which is used as a can lining.

It is known to line cans with bags prior to filling cans with foodstuffs, especially ham, so that the packaged food is not in direct contact with the wall of the can. For this purpose, the bag, usually a bag of plastic film, is inserted into the can in such a manner that it closely fits the inner wall of the can. Then the portion of the bag projecting beyond the opening of the can is folded back over the edge of the can opening. This is necessary to facilitate filling of the bag. After filling, the doubled-back portion of the bag is drawn from the edge of the can opening and is used for covering the goods placed in the can. Finally, the can is closed with a lid, optionally under reduced pressure and at an elevated temperature.

Bags hitherto used for lining cans have normally consisted either of two identical, rectangular sheets of film which were superimposed upon each other and joined along their two long sides and one of the narrow sides, for example by welding or heat sealing, or they have been formed from a tube of plastic material one end of which was closed by welding or heat sealing. As a third alternative, it is possible to join the superposed edges of a semi-tubular film to form the bag.

As already mentioned, the dimensions of these bags must be such that they closely fit the wall of the can when filled.

These known bags have the disadvantage that, owing to the inadequate flexibility of their material, they cannot easily be stretched beyond the inner circumference determined by the can. Consequently, it is difficult for the portion of the bag projecting above the can to be folded back over the edge of the can opening.

SUMMARY OF THE INVENTION

It is therefore an object of the present invention to modify the three-dimensional shape of the known bag in such a manner that it still closely fits the inner wall of the can in the filled state and projects beyond the edge of the can opening, but does not have the above mentioned disadvantage.

A specific object of the invention is to provide such an improved bag wherein it is possible for the portion of the bag which projects from the can to be quickly and easily folded back over the edge of the can.

In accomplishing the foregoing objects, there is provided in accordance with the present invention a bag adapted for lining the inside of a container, comprising side walls and a closed end wall comprised of a flexible synthetic resinous sheet material, preferably heat-sealable material, and an open end wall opposite to the closed end wall, wherein the inside circumference of the bag defined by the side walls becomes increasingly larger from an intermediate point on the side walls in the direction of the open end wall. Preferably the outer circumference of the bag defined by the side walls is substantially constant and the intermediate point corresponds to the top edge of the container when the bag is inserted.

In one embodiment of the invention, at least one side of the bag is bonded together and the width of the bonded area on at least one side of the bag tapers convergently in the direction of the open end.

Also provided according to the invention are a container for accepting foodstuffs and the like, and a method of lining a such container utilizing the above-defined bag according to the invention.

Further objects, features and advantages of the invention will become apparent from the detailed description of preferred embodiments which follows, when considered with the attached drawings.

DETAILED DESCRIPTION OF PREFERRED EMBODIMENTS

According to the present invention a bag of flexible plastic film is provided which is characterized in that the inner circumference of the bag increases toward its opening.

What is meant by the "inner circumference" of the bag is the circumference of the hollow space surrounded by the bag.

In a preferred embodiment, the bag is a flat bag of uniform outer circumference, i.e., in which the two narrow sides are of the same length. Preferably, the inventive modification of the inner circumference of the bag is achieved by providing at least one of the long sides of the bag with a sealing weld the width of which becomes narrower toward the bag opening. In its preferred embodiment, the outward appearance of the bag according to the present invention corresponds therefore to the conventional rectangular shape, whereas its interior is at least in part of a conical or funnel-like shape.

Figure 1:
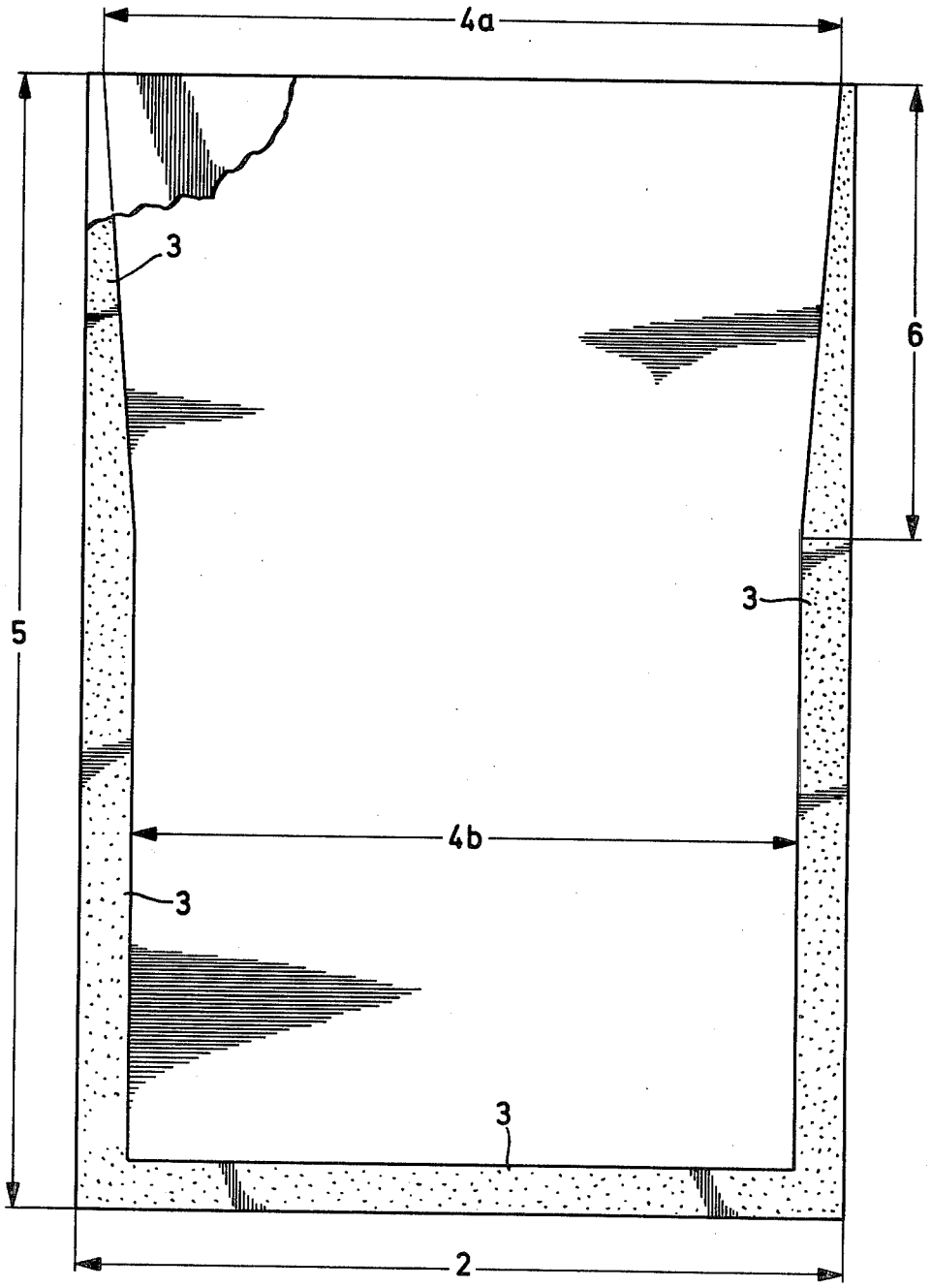
FIG. 1 shows a flat bag according to the invention which consists of two identical sheets of film.

Referring now to the drawings, wherein both bags are shown in the flat, unfilled state, in FIG. 1 two sheets of film are joined by the sealing weld 3 which extends along their two long sides and one short side at the bottom. The sheets are comprised of thermoplastic, heat-sealable film; however, they are preferably a composite film composed, for example, of layers of polyester or polyamide and polyethylene, or of heat-sealable films of, for example, oriented polypropylene film coated with polyolefin, in which case the sheets are combined with each other by heat-sealing the innermost polyethylene layer. The shape of the sealing weld 3 is produced by using appropriately shaped sealing tools.

The inner circumference of the bag diminishes conically from the opening of the bag toward its bottom, the reduction being caused by a widening of the area of the sealing weld.

If the embodiment of the inventive bag shown in FIG. 1 is to be used for canning ham in the normal manner, bags of the following dimensions are used:

| | |
|---|---|
| Entire width 2: | 290 mm |
| Inside width 4a: (at the opening) | 284 mm |
| Inside width 4b: | 276 mm |
| Overall length 5: | 440 mm |
| Length of the modified | |

-continued

| | |
|---|---|
| sealing weld (6): | 60 mm |

Figure 2:
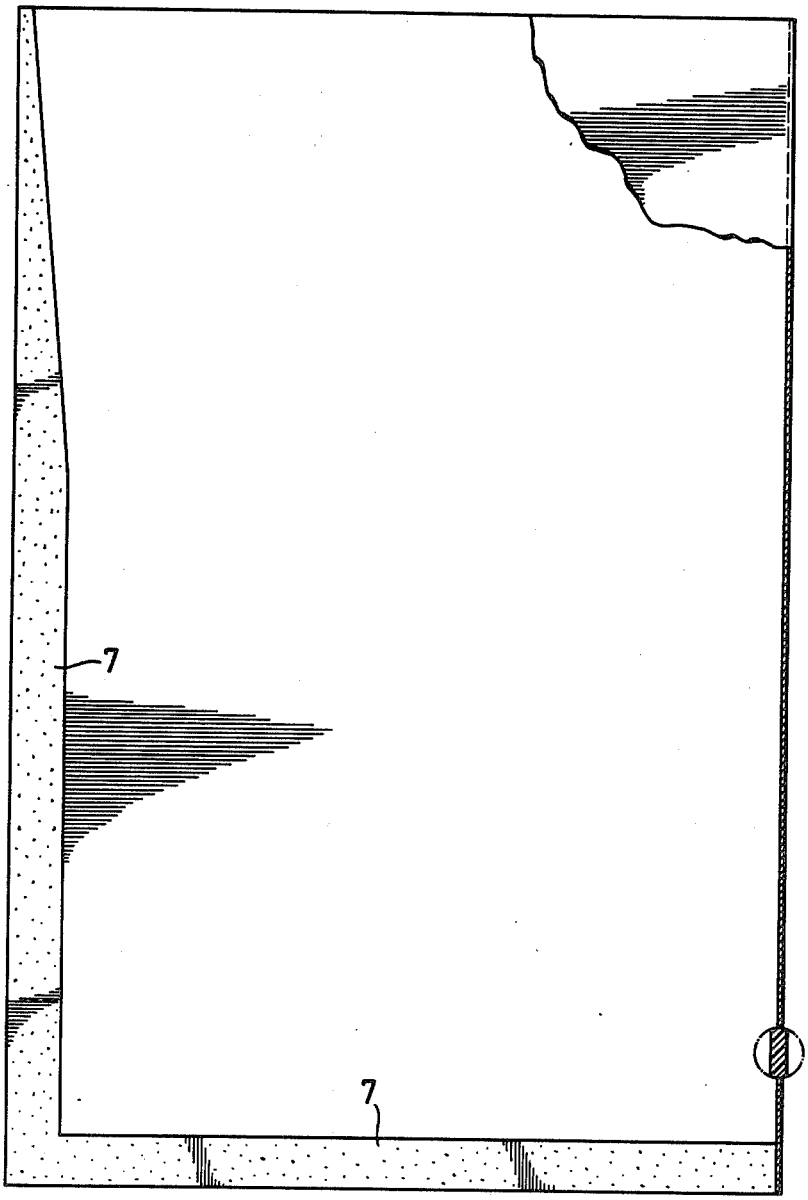
FIG. 2 shows a further embodiment of a bag according to the invention which was obtained by welding a semi-tubular plastic film.

In the embodiment of the invention shown in FIG. 2, the sealing weld is modified along one long side of the bag only.

The overall length 5 of the bag according to the invention must be selected, relative to the height of the can, so that the portion of the bag projecting from the can is sufficient to cover the food which is placed into the can. In this manner, a direct contact between the contents of the can and the lid is avoided. The inside width 4*b* of the bag corresponds approximately to half the inner circumference of the can. Preferably, the width of the sealing weld 3 or 7 produced by heat-sealing diminishes only within the portion of the bag projecting beyond the edge of the can opening.

The flat bags shown in the figures may be replaced by flat-bottom bags, gusseted bags, or cross-bottom bags, which also come under the present invention if they have conical inner circumferences according to the invention.

The bag according to the invention can be rapidly and easily folded back over the edge of the can opening, so that the above described step of lining food cans is considerably facilitated.

What is claimed is:

1. A bag adapted for lining the inside of a container, comprising two side walls having parallel linear edges, a closed end wall, and an open end wall opposite to said closed end wall, said closed end wall and said open end wall being of equal length, said side walls being formed from at least one sheet of a flexible, synthetic resinous, heat-sealable material having their parallel linear edges heat-sealed together with a bond area having a width which tapers convergently on at least one side of said bag from an intermediate point on the side walls in the direction of the open end wall whereby the interior space defined by said side walls becomes increasingly larger from said intermediate point to said open end wall, thereby forming a frusto-conical opening which facilitates the insertion of an object into said bag.

2. The bag as defined by claim 1, wherein said intermediate point corresponds to the top edge of the container when the bag is inserted.

3. The bag as defined by claim 1 wherein said flat sides comprise separate sheets bonded together at their sides and at one end.

4. The bag as defined by claim 3, wherein said heat-sealable synthetic resinous material comprises a composite film of polyester and polyethylene.

5. The bag as defined in claim 3, wherein the bonded area tapers on both sides.

6. The bag as defined in claim 3, wherein the bonded area tapers on one side only.

7. A bag adapted for lining the inside of a container, comprising two side walls having parallel linear edges, a closed end wall, and an open end wall, said side walls being formed from at least one sheet of a flexible, synthetic resinous, heat-sealable material, and said closed end wall and said open end wall being of equal length, said walls defining an interior space which becomes increasingly larger from an intermediate point on said side walls to said open end wall, forming thereby a frusto-conically shaped opening which facilitates insertion of an object into said bag, said bag being produced by heat-sealing the parallel edges of said side walls together with a bond area having a width which tapers convergently on at least one side of said bag from said intermediate point on said side walls to said open end wall.

8. The bag of claim 7, wherein said flat sides comprise separate sheets bonded together at their sides and at one end.

9. The bag of claim 8, wherein said heat-sealable synthetic resinous material comprises a composite film of polyester and polyethylene.

10. The bag of claim 8, wherein the bonded area tapers on both sides.

11. The bag of claim 8, wherein the bonded area tapers on one side only.

* * * * *